United States Patent [19]

Seo et al.

[11] Patent Number: 4,863,708

[45] Date of Patent: Sep. 5, 1989

[54] PROCESS FOR PRODUCING CARBON FIBERS AND THE CARBON FIBERS PRODUCED BY THE PROCESS

[75] Inventors: Ikuo Seo; Yasuo Sakaguchi; Ken Kashiwadate, all of Iwaki, Japan

[73] Assignee: Kureha Kagaku Kogyo Kabushiki Kaisha, Tokyo, Japan

[21] Appl. No.: 293,563

[22] Filed: Jan. 3, 1989

Related U.S. Application Data

[63] Continuation of Ser. No. 773,037, Sep. 6, 1985, abandoned.

[30] Foreign Application Priority Data

Sep. 14, 1984 [JP] Japan ..... 49-193245
Sep. 14, 1984 [JP] Japan ..... 49-193246
Sep. 14, 1984 [JP] Japan ..... 49-193247

[51] Int. Cl.[4] ..... D01F 9/20

[52] U.S. Cl. ..... 423/447.2; 208/22; 208/44; 208/45; 264/29.2; 423/447.4; 423/447.6; 423/447.8

[58] Field of Search ..... 423/447.2, 447.4, 447.6, 423/447.8; 208/22, 44, 45; 264/29.2

[56] References Cited

U.S. PATENT DOCUMENTS 4,402,928 9/1983 Lewis et al. ..... 423/447.2
4,431,513 2/1984 Lewis, II ..... 208/22
4,454,020 6/1984 Izumi et al. ..... 423/447.2
4,496,637 1/1985 Shimada et al. ..... 423/447.2
4,521,294 6/1985 Uemura et al. ..... 423/447.2
4,529,498 7/1985 Watanabe ..... 423/447.2

FOREIGN PATENT DOCUMENTS 0054437 6/1982 European Pat. Off. ..... 423/447.1
0090475 10/1983 European Pat. Off. ..... 423/447.1
51-60281 6/1976 Japan ..... 208/22
2129825 5/1984 United Kingdom ..... 423/447.1

OTHER PUBLICATIONS

Boero, et al., Study of the $AlCl_3$ Catalytic Activity on Aromatic Hydrocarbons-II, Carbon Journal, vol. 19, No. 5, 1981 pp.341-364.

*Primary Examiner*—John Doll
*Assistant Examiner*—Robert M. Kunemund
*Attorney, Agent, or Firm*—Oblon, Spivak, McClelland, Maier & Neustadt

[57] ABSTRACT

Disclosed herein is a process for producing pitch-based carbon fibers having the specific properties comparable to those of polyacrylonitrile(PAN)-based carbon fibers, wherein an optically isotropic pitch obtained by polymerizing naphthalene at a temperature of not more than 330° C. and heating the thus obtained polymeric material at a temperature of 330° to 440° C. while introducing an inert gas thereinto to remove volatile components therefrom, is subjected to melt-spinning, infusibilization (therosetting) and carbonization and the thus obtained carbonized-fibers are subjected to heat treatment at a temperature of not less that 900° C. to obtain the carbon fibers.

9 Claims, No Drawings

PROCESS FOR PRODUCING CARBON FIBERS AND THE CARBON FIBERS PRODUCED BY THE PROCESS

This application is a continuation of application Ser. No. 773,037 filed on Sept. 6, 1985, now abandoned.

BACKGROUND OF THE INVENTION:

The present invention relates to a process for producing pitch-based carbon fibers and the carbon fibers produced by the process, and more in detail, the present invention relates to a process for producing pitch-based carbon fibers having specific properties comparable to those of polyacrylonitrile(PAN)-based carbon fibers by using naphthalene as a starting material, and pitch-based carbon fibers produced by the process thereof.

The carbon fibers which are now commercially available are classified based on the starting material therefor into (1) the carbon fibers produced from PAN, that is, PAN-based carbon fibers and (2) the carbon fibers produced from a pitch, that is, pitch-based carbon fibers. Since PAN-based carbon fibers are generally superior to pitch-based carbon fibers, particularly in tensile strength, most of high performance carbon fibers having high strength and modulus of elasticity have been manufactured from PAN. However, because of the high price of the starting material and the poor yield of carbonization thereof in the PAN-based carbon fibers, studies for producing the pitch-based carbon fibers having comparable tensile strength and Young's modulus to those of PAN-based carbon fibers by using the pitch which can take advantage to PAN as the starting material, have been carried out, and several processes have been proposed.

For instance, a process for producing graphite fibers having a highly three-dimensional order characterized by the cross lattice line (112) and the lines (100) and (101) in the X-ray diffraction pattern and having an interlayer spacing ($d_{002}$) of not more than 3.37 Å, an apparent layer size ($L_a$) of not less than 1000 Å and an apparent layer height ($L_c$) of not less than 1000 Å, has been reported, which process comprises heating a petroleum pitch, a coal-tar pitch or an acenaphthylene pitch at a temperature of 350° to 500° C. for a sufficient time for forming about 40 to 90% by weight of a mesophase in the pitch, thereby preparing a carbonaceous pitch showing non-thixotropy at a spinning temperature and a viscosity of 10 to 200 poise, spinning the thus prepared pitch into fibers, subjecting the thus spun fibers to infusibilization (thermosetting) at a temperature of 250° to 400° C. in oxygen-containing atmosphere, heating the infusibilized fibers to a temperature of not less than 1,000° C. in an inert atmosphere and further heating the thus treated fibers to a temperature of not less than about 2,500° C. (refer to Japanese Patent Application Laid-Open No. 49-19127 (1974)).

As is disclosed in Japanese Patent Application Laid Open No. 49-19127 (1974) hitherto it has been considered that in order to produce the high performance carbon fibers from pitch, the use of a mesophase pitch as the starting precursor material is indispensable, because in the case of melt-spinning the mesophase pitch which has molecular orientation, the molecules of the pitch are easily aligned parallel to the fiber axis. However, because of the high softening point the mesophase pitch, the spinning temperature thereof is also high and there is a weak point that at such a high temperature of melt-spinning, the pitch is thermally unstable. In addition, since the mesophase pitch is a heterogeneous mixture containing the isotropic pitch and the pitch liquid crystal, it has been considered that the homogeneous pitch fibers are hardly obtainable.

In order to solve the above-mentioned weak point, a pitch usable as the starting material for melt-spinning, which is not necessarily optically anisotropic before melt-spinning, however, is excellent in spinning property and transforms into optically anisotropic state after being melt-spun or carbonized, , and a process for producing carbon fibers by using such a pitch are proposed.

For instance, a process comprising (1) melt-spinning an optically isotropic premesophase carbonaceous substance or a pitch-like substance mainly composed of an optically isotropic premesophase carbonaceous substance under the melt spinning conditions, which does not substantially increase the content of the mesophase carbonaceous material, (2) infusibilizing the thus melt-spun fibers and (3) carbonizing the thus infusibilized fibers, thereby transforming the premesophase carbonaceous substance or the pitch-like substance containing the premesophase carbonaceous substance into the optically anisotropic mesophase carbonaceous substance is disclosed (refer to Japanese Patent Application Laid-Open No. 58-18421 (1983)). Further a dormant anisotropic pitch of the atomic ratio of hydrogen to carbon (H/C) of 0.55 to 1.2, which (1) contains as a component for forming the dormant anisotropy, a substantially quinoline-soluble polycyclic polycondensed ring type hydrocarbon which is obtained by partially hydrogenating polycyclic polynuclear hydrocarbons existing in mesophase pitch, (2) forms, in the molten state thereof, a wholly heterogeneous homogeneous and optically isotropic single phase without substantially forming mesophase and (3) in the case where an orientation along the direction of the external force, is disclosed (refer to Japanese Patent Application Laid-Open No. 57-100186 (1982)).

However, in every case thereof, it has been considered necessary to hydrogenate the pitch as the starting material. In addition, in the former case, there is no concrete example of producing the carbon fibers while using only the premesophase pitch, i.e., the quinoline-soluble pitch as the starting material, and the pitch used in melt-spinning generally contains the quinoline-insoluble component.

Further, in order to solve the above-mentioned weak point, the pitch-based carbon fibers having a preferred orientation (22°) of 30° to 50°, an apparent crystallite size ($L_c$) of 12 to 80 Å and an interlayer spacing ($d_{002}$) of 3.4 to 3.6 Å, measured by X-ray diffractometry, the tensile strength of not less than 200 kgf/mm$^2$ and the Young's modulus of 10,000 kgf/mm$^2$ is disclosed in Japanese Patent Application Laid-Open No. 59-53717 (1984). The carbon fibers disclosed in Japanese Patent Application Laid-Open No. 59-53717 (1984) is produced by the process comprising (1) after refining a coal-based heavy oil such as coal tar, coal tar pitch and liquefied coal; topped crude and vacuum residue, tar and pitch by-produced through heat-treatment of the above residues; oilsand and bitumen, adding a solvent for hydrogenation thereto, (2) heating the thus prepared mixture at a temperature of 300° to 500° C. for 10 to 60 min, (3) further heating the thus treated mixture at a temperature of not less than 450° C. for 5 to 60 min under a reduced pressure, thereby obtaining a premesophase pitch for melt-spinning, (4) after heating the pitch for melt-spinning to a temperature of higher than "the temperature of viscosity change", subjecting the thus heated pitch to melt spinning, (5) after quenching the thus melt-spun fibers, subjecting the quenched fibers to infusibilization at a temperature of 250° to 350° C., and (6) heating the thus infusibilized fibers to a temperature of 1,000° to 1,500° C. in an inert gas.

In general, the mechanical properties of carbon fibers depend on the higher order structure. For instance, in order that the carbon fibers are excellent in Young's modulus, it is indispensable that the carbon fibers have a fiber structure and high degree of orientation thereof. Hitherto, in order to produce the pitch-based carbon fibers of high Young's modulus, it has been necessary to use a mesophase pitch which is obtained by thermally treating a raw material such as tar and pitch and crystallizing the carbonaceous material, a dormant anisotropic pitch or a premesophase pitch as the starting material.

Although the pitch-based carbon fibers produced by any process are superior to the PAN-based carbon fibers in the graphitizability, the former is inferior to the latter in tensile strength and it is yet impossible to offer the pitch-based carbon fibers which have the mechanical properties comparable to those of the PAN-based carbon fibers.

As a result of the present inventors' studies for producing the pitch-based carbon fibers having the excellent mechanical properties such as tensile strength, Young's modulus and elongation at break comparable to or superior to those of PAN-based carbon fibers, the present inventors have found that the carbon fibers obtained by the process comprising (1) producing an optically isotropic pitch of a specified molecular structure and molecular weight by catalytically polymerizing naphthalene at a temperature of not more than 330° C., (2) heating the thus obtained polymeric material at a temperature of 330° to 440° C. while introducing an inert gas thereinto to remove volatile components therefrom, (3) melt-spinning the thus obtained pitch, (4) subjecting the thus spun fibers to infusibilization, (5) carbonizing the thus infusibilized fibers, and (6) subjecting the thus carbonized fibers to heat treatment, are surprisingly provided with a fiber structure in which the carbon network planes are oriented parallel to the fiber axis and exhibit excellent mechanical properties such as high strength and high elongation at break which have not been observed by the conventional pitch-based high performance carbon fibers, and based on the above-mentioned findings, the present inventors have attained the present invention.

SUMMARY OF THE INVENTION:

In a first aspect of the present invention, there is provided a process for producing carbon fibers having an apparent crystallite size ($L_{c(002)}$) of 15 to 200 Å and an interlayer spacing ($d_{002}$) of 3.371 to 3.47 Å measured by X-ray diffractiometry, comprising polymerizing naphthalene at a temperature of not more than 330° C. in the presence of a Lewis acid catalyst for 0.5 to 100 hours, after removing the catalyst from reaction mixture, heating the thus obtained polymeric material to a temperature of 330° to 440° C. under an atmospheric pressure or a reduced pressure while introducing an inert gas thereinto to remove volatile components therefrom, thereby obtaining an optically isotropic pitch having a softening point of 180° to 200° C., an atomic ratio of hydrogen to carbon (H/C) of 0.6 to 0.8 and an average molecular weight of 800 to 1500, and containing 35 to 45% by weight of a benzene-insolubles without containing any quinoline-insolubles, melt-spinning pitch fibers from the thus obtained optically isotropic pitch, infusibilizing the thus obtained pitch fibers and carbonizing the thus infusibilized carbon fibers, and subjecting the thus carbonized fibers to heat treatment at a temperature of not less than 900° C.

In a second aspect of the present invention, there is provided carbon fibers having a preferred orientation (22°) of larger than 50°, an apparent crystallite size ($L_{c(002)}$) of 15 to 50 Å and an interlayer spacing ($d_{002}$) of 3.44 to 3.47 Å measured by X-ray diffractiometry and also having a tensile strength of not less than 200 kgf/mm$^2$ and a Young's modulus of not less than 9500 kgf/mm$^2$, produced by subjecting a carbonized pitch fibers made from naphthalene as a starting material to heat treatment at a temperature of 900° to 1600° C.

In a third aspect of the present invention, there is provided carbon fibers having a preferred orientation (22°) of below 30°, an apparent crystallite size ($L_{c(002)}$) of over 80 Å and not more than 200 Å and an interlayer spacing ($d_{002}$) of 3.371 to 3.440 Å measured by X-ray diffractiometry and also having a tensile strength of not less than 300 kgf/mm$^2$ and a Young's modulus of not less than 20000 kgf/mm$^2$, produced by subjecting the carbonized pitch fibers made from naphthalene as a starting material to heat treatment at a temperature of 2000° to 3000° C.

DETAILED EXPLANATION OF THE INVENTION

The present invention relates to a process for producing pitch-based carbon fibers, comprising (1) producing an optically isotropic carbonaceous pitch having a softening point of 180° to 200° C., an atomic ratio of hydrogen to carbon (H/C) of 0.6 to 0.8, an average molecular weight of 800 to 1500, and containing the benzene-insolubles of 35 to 45% by weight without containing any quinoline-insolubles by polymerizing naphthalene in the presence of a Lewis acid catalyst at a temperature of not more than 330° C. for 0.5 to 100 hours and after removing the catalyst from the reaction mixture, removing volatile components therefrom from by heating the thus obtained polymeric material to 330° to 440° C. and introducing an inert gas thereinto under an atmospheric pressure or a reduced pressure, (2) melt-spinning pitch fibers from the thus obtained pitch, (3) subjecting the thus spun fibers to infusibilization, (4) carbonizing the thus infusibilized fibers and (5) subjecting the thus carbonized fibers to heat treatment in an inert atmosphere at a temperature of not less than 900° C., preferably from 900° to 3,000° C.

The carbon fibers' obtained according to the process of the present invention have, as the results by X-ray diffractiometry, an apparent crystallite size ($L_{c(002)}$) of 15 to 200 Å and an interlayer spacing ($d_{002}$) of 3.371 to 3.47 Å.

The carbon fibers according to the present invention, which have the above-mentioned apparent crystallite size and interlayer spacing and have a uniformly oriented structure also have the superior mechanical strength to that of the conventional pitch-based high performance carbon fibers. Namely the carbon fibers produced according to the process of the present invention have the tensile strength of not less than 200 kgf/mm$^2$ and the Young's modulus of not less than 9,500 kgf/mm$^2$.

The optically isotropic carbonaceous pitch produced by the specified process while using naphthalene as the starting material can be melt-spun at a lower temperature than the temperature at which mesophase pitch is melt-spun, and it is possible to obtain the homogeneous pitch fibers from the pitch according to the present invention without adopting any specified spinning conditions. In addition, since the intermolecular force between pitch molecules in the pitch fibers obtained from the optical isotropic carbonaceous pitch produced by the process according to the present invention is not so high as that in the pitch fibers obtained from the mesophase pitch, on subjecting the melt-spun pitch fibers of the present invention to infusibilization, fine mosaic texture is formed in the skin layer of the pitch fibers as the infusibilization proceeds and on the other hand, the favorable molecular orientation in the core part of the pitch fibers is not disturbed by the infusibilization , thereby obtaining infusibilized fibers provided with an excellent fiber structure.

The process for production of the carbon fibers according to the present invention will be explained more in detail as follows.

In the first step, naphthalene used as the starting material is polymerized in the presence of a Lewis acid catalyst by heating at a temperature of not more than 330° C., preferably 100° to 300° C. for 0.5 to 100 hours, preferably over 20 hours and not more than 60 hours.

As a Lewis acid catalyst, $AlCl_3$ and $BF_3$ may be exemplified, however, $AlCl_3$ is preferable. Although from 5 to 50 parts by weight of a Lewis acid a catalyst may be used to 100 parts by weight of naphthalene, it is preferable to use over 10 parts and not more than 20 parts by weight of a Lewis acid catalyst to 100 parts by weight of naphthalene. In addition, since a mesophase pitch which is a quinoline-insoluble is formed when the temperature of heating naphthalene is over 330° C., it is not favorable to heat naphthalene to a temperature of over 330° C. In the case of using a Lewis acid catalyst not more than 10 parts by weight, a yield of an optically isotropic pitch is not so high. Also, in the case of using a Lewis acid catalyst over 20 parts by weight, a yield of an optically isotropic pitch is not so much improved, and in the case of using a Lewis acid catalyst over 50 parts by weight, the removal of the catalyst after finishing the polymerization is difficult and accordingly, the excess use of the catalyst is not economical.

After removing the catalyst from the reaction mixture, an inert gas is introduced to the thus obtained polymeric material while heating to a temperature of 330° to 440° C., preferably 350° to 420° C. under an atmospheric pressure or a reduced pressure to remove the volatile components therefrom, and as a result the optically isotropic carbonaceous pitch is obtained. In the case where the temperature is over 440° C., since the mesophase pitch which is a quinoline-insoluble is formed, it is not favorable to heat to a temperature of over 440° C.

The heat-treatment of the polymeric material obtained by polymerizing naphthalene is carried out for not more than 40 min, preferably 1 to 30 min.

The thus obtained carbonaceous pitch which is the precursor for the carbon fibers of the present invention, i.e., the starting material for spinning has a softening point of 180° to 200° C., an atomic ratio of hydrogen to carbon (H/C) of 0.6 to 0.8 and an average molecular weight of 800 to 1,500 and contains 35 to 45% by weight of benzene-insoluble component, without containing any quinoline-insoluble component, and exhibits optical isotropy under a polarizing microscope.

In order to produce the carbon fibers excellent in mechanical properties according to the present invention, it is necessary that the pitch as the starting material for spinning is to be the carbonaceous pitch which fulfills the above-mentioned several properties.

The thus obtained carbonaceous pitch is subjected to melt-spinning and infusibilization. For instance, melt-spinning is carried out by extruding the pitch at a temperature of higher than the softening point of the pitch by 70° to 90° C. from the nozzle under a pressure of 0.5 to 2.0 kgf/cm$^2$ G and the spun pitch fibers are taken-up at a rate of 300 to 1,000 m/min.

Infusibilization (thermosetting) is carried out by heating the thus spun fibers to a temperature of 230° to 300° C. at a rate of 0.5° to 5° C./min in an oxidative atmosphere and maintaining for 30 to 60 min.

The thus infusibilized fibers are carbonized by heating to a temperature of lower than 900° C. at a rate of 5° to 15° C./min in an inert atmosphere, for instance, nitrogen gas.

The thus carbonized fibers are subjected to heat treatment under each of the following three conditions to obtain the carbon fibers excellent in mechanical properties according to the present invention.

(1) Heat treatment at a temperature of 900° to 1,600° C.

By heating the thus carbonized fibers to a predetermined temperature in a range of 900° to 1,600° C. in an inert gas, for instance, nitrogen gas, and optionally maintaining at the predetermined temperature, the carbon fibers having the following structure parameters and mechanical properties are obtained.

Structure parameters determined by X-ray diffractiometry:

Preferred orientation (22°): larger than 50°, preferably larger than 50° and not more than 80°.

Apparent crystallite size ($L_{c(002)}$): 15 to 50 Å, preferably 20 to 30 Å.

Interlayer spacing ($d_{002}$) 3.44 to 3.47 Å, preferably 3.441 to 3.461 Å.

Mechanical properties:

Tensile strength: not less than 200 kgf/mm$^2$, Young's modulus: not less than 9,500 kgf/mm$^2$.

(2) Heat treatment at a temperature of over 1,600° and below 2,000° C.

By heating the thus carbonized fibers to a predetermined temperature in a range of over 1,600° and below 2,000° C. in an inert gas, for instance nitrogen gas, and optionally maintaining at the predetermined temperature, the carbon fibers having the following structure parameters and mechanical properties are obtained.

Structure parameters determined by X-ray diffractiometry:

Preferred orientation (22°): 30° to 50°, preferably 35° to 48°. Apparent crystallite size ($L_{c(002)}$) over 50 Å and not more than 80 Å, preferably 54 to 78 Å.

Interlayer spacing ($d_{002}$) 3.43 to 3.45 Å, preferably 3.433 to 3.444 Å.

Mechanical properties:

Tensile strength: not less than 250 kgf/mm$^2$, Young's modulus: not less than 15,000 kgf/mm$^2$.

(3) Heat treatment at a temperature of not less than 2,000° C.

By heating the thus carbonized fibers to a predetermined temperature of not less than 2000° C., preferably 2,000° to 3,000° C. in an inert gas, for instance, argon gas, and optionally maintaining at the predetermined temperature, the carbon fibers having the following structure parameters and mechanical properties are obtained.

Structure parameters determined by X-ray diffractiometry:

Preferred orientation (22°): below 30°, preferably 15° to 25°.

Apparent crystallite size ($L_{c(002)}$) over 80 Å and not more than 200 Å, preferably 90 to 170 Å.

Interlayer spacing ($d_{002}$) 3.371 to 3.440 Å, preferably 3.390 to 3.430 Å.

Mechanical properties:

Tensile strength: not less than 300 kgf/mm$^2$,

Young's modulus: not less than 20,000 kgf/mm$^2$.

The thus obtained carbon fibers according to the present invention has the tensile strength and the Young's modulus comparable to or superior to those of the PAN-based carbon fibers respectively and according to the process of the present invention, the carbon fibers having the above mentioned properties may be obtained in a high yield of carbonization.

The parameter used for indicating the respective, specific properties of the carbon fibers and pitches in the present invention are explained as follows.

(1) Structure parameters

"Preferred orientation (22°)", "Apparent crystallite size ($L_c$)" in the direction parallel to c-axis and "Interlayer spacing ($d_{002}$)" are structure parameters representing the higher order structure of the fibers, the parameters being obtained from the wide-angle X-ray diffraction pattern of the carbon fibers.

Preferred orientation (22°) corresponds to the degree of orientation of the crystallite to the fiber axis direction, and the smaller is the angle, the higher is the degree of orientation of the crystallite.

Apparent crystallite size ($L_c$) represents the apparent stack height of carbon network plane along the c-axis.

Interlayer spacing ($d_{002}$) represents the spacing between the carbon network planes in the crystallite.

By rotating the bundle of the fibers through 180° in the plane perpendicular to the X-ray beam at the position of the angle of diffraction at which the maximum intensity of the (002) diffraction is observed, the azimuthal distribution of intensity along the (002) diffraction ring is obtained, and the full width at the position wherein the intensity is a half of the maximum is defined as the "Preferred orientation (22°)" "Apparent crystallite size ($L_c$)" and "Interlayer spacing ($d_{002}$)" are obtained by the method proposed by 117 Committee of Japan Society for the Promotion of Science (refer to "TANSO" No. 36, page 5 (1963)).

(2) Physical property of pitch

Molecular weight

Molecular weight, of the pitch is measured by using a vapour pressure osmometer (Molecular weight-measuring apparatus type 117 made by Corona Co., Ltd.) in pyridine as the solvent while using benzil as the standard substance.

Atomic ratio of hydrogen to carbon (H/C)

From the elementary analysis data obtained by the method of Japanese Industrial Standards (JIS) M-8813, H/C is calculated from the following formula.

$$H/C = \frac{\text{(hydrogen content, \% by weight)}/1}{\text{(carbon content, \% by weight)}/12}$$

Softening point

After introducing 1 g of the pitch which is finely pulverized to 100 mesh-pass (not more than 149$\mu$) into a heating cylinder of 10 mm in inner diameter with a nozzle of 1 mm in dia meter (L/D=1.0)of a KOKKA-type flowtester (made by SHIMAZU SEISAKUSHO Co., Ltd.) and while applying a pressure of 10 kgf/cm$^2$ with a piston of the apparatus from above, the specimen of the pitch is heated at a rate of 6° C./min. By recording automatically the vertical movement of the piston with the temperature of the specimen, a curve (movement vs temperature) is obtained. The softening point is defined as the temperature of an inflection point of the curve.

Content of solvent-insoluble components

Content of solvent (such as benzene and quinoline)insoluble component in the pitch was measured by following the testing method of Japanese Industrial Standards (JIS) K-2425.

(3) Physical properties of the carbon fibers

The diameter, tensile strength, elongation at break and Young's modulus of the carbon fibers were measured by following the testing method of Japanese Industrial Standards (JIS) R-7601.

The present invention will be explained more in detail while referring to the nonlimitative Examples as follows.

EXAMPLE 1

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 210° C. for 60 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (I).

The thus obtained carbonaceous pitch (I) exhibited optical isotropy under a polarizing microscope, the physical properties thereof being shown in Table 1.

The thus obtained carbonaceous pitch (I) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibiliza tion by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then maintained at a temperature of 900° C. in the same atmosphere for about 30 min to obtain the carbon fibers of diameter of 8.5μ according to the present invention, the structure parameters of the thus obtained carbon fibers measured by X-ray diffractiometry and the mechanical properties thereof being shown in Table 2.

EXAMPLE 2

The carbon fibers obtained in Example 1 were further subjected to heat treatment by heating to a temperature of 1200° C. at a rate of about 50° C./min in a nitrogen atmosphere and then maintaining at a temperature of 1200° C. for about 10 min in the same atmosphere.

The structure parameters measured by X-ray diffractiometry and mechanical properties of the thus obtained carbon fibers of diameter of 8μ are also shown in Table 2.

EXAMPLE 3

Into an autoclave provided with a magnetic induction stirring device, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and after sufficiently replacing the atmosphere in the autoclave with nitrogen gas, the mixture was polymerized at a temperature of 300° C. for 1 hour with stirring under a pressure of 0 kgf/cm$^2$G.

After the polymerization was over, the reaction mixture was washed with water and then filtrated with a filter to remove the catalyst, thereby obtaining a crude pitch. The thus obtained crude pitch was heated at a temperature of 350° C. for 30 min under a pressure of 12 Torr while introducing nitrogen gas thereinto to remove the volatile components therefrom, thereby obtaining a carbonaceous pitch (II).

The thus obtained carbonaceous pitch (II) exhibited optical isotropy under a polarizing microscope, the physical properties thereof being shown in Table 1.

The thus obtained carbonaceous pitch (II) was introduced into a cylinder barrel provided with a nozzle of 0.3 mm in diameter and after melting the pitch by heating to a temperature of 275° C., the molten pitch was spun into fibers by extruding from the nozzle under a pressure of 0.8 kgf/cm$^2$G and the thus spun pitch fibers were taken-up at a rate of about 600 m/min. The thus obtained pitch fibers were subjected to infusibilization by heating to a temperature of 250° C. at a rate of about 1° C./min in air and then maintaining at a temperature of 250° C. for about 30 min in air.

The thus infusibilized fibers were carbonized by heating to a temperature of 900° C. at a rate of about 5° C./min in a nitrogen atmosphere and then maintained at a temperature of 900° C. in the same atmosphere for about 30 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 4

The carbon fibers obtained in Example 3 were further subjected to heat treatment by heating to a temperature of 1200° C. at a rate of about 50° C./min in a nitrogen atmosphere and then maintaining at a temperature of 1200° C. for about 10 min in the same atmosphere.

The structure parameters measured by X-ray diffractiometry and mechanical properties of the thus obtained carbon fibers of diameter of 8μ are also shown in Table 2.

EXAMPLE 5

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 100° C. for 60 hours under stirring. Then, 100 g of $AlCl_3$ (the same reagent as above) were further added to the reaction mixture and the thus obtained mixture was further polymerized for 30 hours at a temperature of 210° C. After the polymerization was over, the reaction mixture was washed with water and then filtrated with a filter to remove the catalyst, thereby obtaining a crude pitch. The thus obtained crude pitch was heated at a temperature of 380° C. for 20 min under a pressure of 10 Torr while introducing nitrogen gas thereinto to remove the volatile components therefrom, thereby obtaining a carbonaceous pitch (III).

The thus obtained carbonaceous pitch (III) exhibited optical isotropy under a polarizing microscope, the physical properties thereof being shown in Table 1.

The thus obtained carbonaceous pitch (III) was introduced into a cylinder barrel provided with a nozzle of 0.3 mm in diameter and after melting the pitch by heating to a temperature of 275° C., the molten pitch was spun into fibers by extruding from the nozzle under a pressure of 1.2 kgf/cm$^2$G and the thus spun pitch fibers were taken-up at a rate of about 500 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then maintained at a temperature of 900° C. in the same atmosphere for about 30 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 6

The carbon fibers obtained in Example 5 were further subjected to heat treatment by heating to a temperature of 1200° C. at a rate of about 50° C./min in a nitrogen atmosphere and then maintaining at a temperature of 1200° C. for about 10 min in the same atmosphere.

The structure parameters measured by X-ray diffractiometry and mechanical properties of the thus obtained carbon fibers of diameter of 8μ are also shown in Table 2.

EXAMPLE 7

Into a three-necked glass flask provided with a stirrer, 1000 g of naphthalene (first grade reagents, made by KANTO Chemical Co., Ltd.) and 120 g of $AlCl_3$ (first grade reagents, made by KANTO Chemical Co., Ltd.) as a catalyst were introduced, and the mixture was polymerized at a temperature of 200° C. for 25 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components there from, thereby obtaining a carbonaceous pitch (IV).

The thus obtained carbonaceous pitch (IV) exhibited optical isotropy under a polarizing microscope, the physical properties thereof being shown in Table 1.

The thus obtained carbonaceous pitch (IV) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then maintained at a temperature of 900° C. in the same atmosphere for about 30 min to obtain the carbon fibers according to the present invention, the structure parameters of the thus obtained carbon fibers measured by X-ray diffractiometry and the mechanical properties thereof being shown in Table 2.

EXAMPLE 8

The carbon fibers obtained in Example 7 were further subjected to heat treatment by heating to a temperature of 1200° C. at a rate of about 50° C./min in a nitrogen atmosphere and then maintaining at a temperature of 1200° C. for about 10 min in the same atmosphere.

The structure parameters measured by X-ray diffractiometry and mechanical properties of the thus obtained carbon fibers are also shown in Table 2.

EXAMPLE 9

Into a three-necked glass flask provided with a stirrer, 1000 g of naphthalene (first grade reagents, made by KANTO Chemical Co., Ltd.) and 150 g of $AlCl_3$ (first grade reagents, made by KANTO Chemical Co., Ltd.) as a catalyst were introduced, and the mixture was polymerized at a temperature of 200° C. for 25 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (V).

The thus obtained carbonaceous pitch (V) exhibited optical isotropy under a polarizing microscope, the physical properties thereof being shown in Table 1.

The thus obtained carbonaceous pitch (V) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then maintained at a temperature of 900° C. in the same atmosphere for about 30 min to obtain the carbon fibers according to the present invention, the structure parameters of the thus obtained carbon fibers measured by X-ray diffractiometry and the mechanical properties thereof being shown in Table 2.

EXAMPLE 10

The carbon fibers obtained in Example 9 were further subjected to heat treatment by heating to a temperature of 1200° C. at a rate of about 50° C./min in a nitrogen atmosphere and then maintaining at a temperature of 1200° C. for about 10 min in the same atmosphere.

The structure parameters measured by X-ray diffractiometry and mechanical properties of the thus obtained carbon fibers are also shown in Table 2.

EXAMPLE 11

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 210° C. for 60 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (I).

The thus obtained carbonaceous pitch (I) exhibited optical isotropy under a polarizing microscope, the physical properties thereof being shown in Table 1.

The thus obtained carbonaceous pitch (I) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$ G and the thus spun pitch fibers were taken-up at a rate of about 700 m/min. The thus obtained pitch fibers were subjected to infusibiliza tion by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere, and then subjected to heat treatment by heating to a temperature of 1650° C. at a rate of increasing temperature of about 50° C./min and then maintaining at a temperature of 1650° C. in the same atmosphere for about 10 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 12

The carbon fibers obtained in Example 11 were further subjected to heat treatment by heating to a temperature of 1800° C. at a rate of about 50° C./min in a nitrogen atmosphere and then maintaining at a temperature of 1800° C. for about 10 min in the same atmosphere.

The structure parameters measured by X-ray diffractiometry and mechanical properties of the thus obtained carbon fibers of diameter of 7.5μ are also shown in Table 2.

EXAMPLE 13

Into an autoclave provided with a magnetic induction stirring device, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and after sufficiently replacing the atmosphere in the autoclave with nitrogen gas, the mixture was polymerized at a temperature of 300° C. for 1 hour with stirring under a pressure of 0 kgf/cm$^2$G.

After the polymerization was over, the reaction mixture was washed with water and then filtrated with a filter to remove the catalyst, thereby obtaining a crude pitch. The thus obtained crude pitch was heated at a temperature of 350° C. for 30 min under a pressure of 12 Torr while introducing nitrogen gas thereinto to remove the volatile components therefrom, thereby obtaining a carbonaceous pitch (II).

The thus obtained carbonaceous pitch (II) exhibited optical isotropy under a polarizing microscope, the physical properties thereof being shown in Table 1.

The thus obtained carbonaceous pitch (II) was introduced into a cylinder barrel provided with a nozzle of 0.3 mm in diameter and after melting the pitch by heating to a temperature of 275° C., the molten pitch was spun into fibers by extruding from the nozzle under a pressure of 0.8 kgf/cm$^2$G and the thus spun pitch fibers were taken-up at a rate of about 600 m/min. The thus obtained pitch fibers were subjected to infusibilization by heating to a temperature of 250° C. at a rate of about 1° C./min in air and then maintaining at a temperature of 250° C. for about 30 min in air.

The thus infusibilized fibers were carbonized by heating to a temperature of 900° C. at a rate of about 5° C./min in a nitrogen atmosphere and then subjected to heat treatment by heating to a temperature of 1650° C. at a rate of about 50° C./min and then maintaining at a temperature of 1650° C. in the same atmosphere for about 10 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 14

The carbon fibers obtained in Example 13 were further subjected to heat treatment by heating to a temperature of 1800° C. at a rate of about 50° C./min in a nitrogen atmosphere and then maintaining at a temperature of 1800° C. for about 10 min in the same atmosphere.

The structure parameters measured by X-ray diffractiometry and mechanical properties of the thus obtained carbon fibers of diameter of 8μ are also shown in Table 2.

EXAMPLE 15

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 100° C. for 60 hours under stirring. Then, 100 g of $AlCl_3$ (the same reagent as above) were further added to the reaction mixture and the thus obtained mixture was further polymerized for 30 hours at a temperature of 210° C. After the polymerization was over, the reaction mixture was washed with water and then filtrated with a filter to remove the catalyst, thereby obtaining a crude pitch. The thus obtained crude pitch was heated at a temperature of 380° C. for 20 min under a pressure of 10 Torr while introducing nitrogen gas thereinto to remove the volatile components therefrom thereby obtaining a carbonaceous pitch (III).

The thus obtained carbonaceous pitch (III) exhibited optical isotropy under a polarizing microscope, the physical properties thereof being shown in Table 1.

The thus obtained carbonaceous pitch (III) was introduced into a cylinder barrel provided with a nozzle of 0.3 mm in diameter and after melting the pitch by heating to a temperature of 275° C., the molten pitch was spun into fibers by extruding from the nozzle under a pressure of 1.2 kgf/cm$^2$G and the thus spun pitch fibers were taken-up at a rate of about 500 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 1650° C. at a rate of about 50° C./min and then maintaining at a temperature of 1650° C. in the same atmosphere for about 10 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 16

The carbon fibers obtained in Example 15 were further subjected to heat treatment by heating to a temperature of 1800° C. at a rate of about 50° C./min in a nitrogen atmosphere and then maintaining at a temperature of 1800° C. for about 10 min in the same atmosphere.

The structure parameters measured by X-ray diffractiometry and mechanical properties of the thus obtained carbon fibers of diameter of 8μ are also shown in Table 2.

EXAMPLE 17

Into a three-necked glass flask provided with a stirrer, 1000 g of naphthalene (first grade reagents, made by KANTO Chemical Co., Ltd.) and 120 g of $AlCl_3$ (first grade reagents, made by KANTO Chemical Co., Ltd.) as a catalyst were introduced, and. the mixture was polymerized at a temperature of 200° C. for 25 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (IV).

The thus obtained carbonaceous pitch (IV) exhibited optical isotropy under a polarizing microscope, the physical properties thereof being shown in Table 1.

The thus obtained carbonaceous pitch (IV) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 1650° C. at a rate of increasing temperature of about 50° C./min and then maintaining at a temperature of 1650° C. in the same atmosphere for about 10 min to obtain the carbon fibers according to the present invention, the structure parameters of the thus obtained carbon fibers measured by X-ray diffractiometry and the mechanical properties thereof being shown in Table 2.

EXAMPLE 18

The carbon fibers obtained in Example 17 were further subjected to heat treatment by heating to a temperature of 1800° C. at a rate of about 50° C./min in a nitrogen atmosphere and then maintaining at a temperature of 1800° C. for about 10 min in the same atmosphere.

The structure parameters measured by X-ray diffractiometry and mechanical properties of the thus obtained carbon fibers are also shown in Table 2.

EXAMPLE 19

Into a three-necked glass flask provided with a stirrer, 1000 g of naphthalene (first grade reagents, made by KANTO Chemical Co., Ltd.) and 150 g of $AlCl_3$ (first grade reagents, made by KANTO Chemical Co., Ltd.) as a catalyst were introduced, and the mixture was polymerized at a temperature of 200° C. for 25 hours under stirring. After the polymerization was over, the reaction mixture was washed with water and the filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (V).

The thus obtained carbonaceous pitch (V) exhibited optical isotropy under a polarizing microscope, the physical properties thereof being shown in Table 1.

The thus obtained carbonaceous pitch (V) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of increasing temperature of about 5° C./min in a nitrogen atmosphere and then subjected to heat treatment by heating to a temperature of 1650° C. at a rate of about 50° C./min and then maintaining at a temperature of 1650° C. in the same atmosphere for about 10 min to obtain the carbon fibers-according to the present invention, the structure parameters of the thus obtained carbon fibers measured by X-ray diffractiometry and the mechanical properties thereof being shown in Table 2.

EXAMPLE 20

The carbon fibers obtained in Example 19 were further subjected to heat treatment by heating to a temperature of 1800° C. at a rate of about 50° C./min in a nitrogen atmosphere and then maintaining at a temperature of 1800° C. for about 10 min in the same atmosphere.

The structure parameters measured by X-ray diffractiometry and mechanical properties of the thus obtained carbon fibers are also shown in Table 2.

EXAMPLE 2

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 210° C. for 60 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (I).

The thus obtained carbonaceous pitch (I) exhibited optical isotropy under a polarizing microscope, the physical properties thereof being shown in Table 1.

The thus obtained carbonaceous pitch (I) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 2000° C. at a rate of about 50° C./min and then maintaining at a temperature of 2000° C. in an argon atmosphere for about 10 min to obtain the carbon fibers of diameter of 8$\mu$ according to the present invention, the structure parameters of the thus obtained carbon fibers measured by X-ray diffractiometry and the mechanical properties thereof being shown in Table 2.

EXAMPLE 22

The carbon fibers obtained in Example 21 were further subjected to heat treatment by heating to a temperature of 2500° C. at a rate of about 50° C./min in an argon atmosphere and then maintaining at a temperature of 2500° C. for about 10 min in the same atmosphere.

The structure parameters measured by X-ray diffractiometry and mechanical properties of the thus obtained carbon fibers of diameter of 7.5μ are also shown in Table 2.

EXAMPLE 23

The carbon fibers obtained in Example 21 were further subjected to heat treatment by heating to a temperature of 2800° C. at a rate of about 50° C./min in an argon atmosphere and then maintaining at a temperature of 2800° C. for about 10 min in the same atmosphere.

The structure parameters measured by X-ray diffractiometry and mechanical properties of the thus obtained carbon fibers of diameter of 7.5μ are also shown in Table 2.

EXAMPLE 24

Into an autoclave provided with a magnetic induction stirring device, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and after sufficiently replacing the atmosphere in the autoclave with nitrogen gas, the mixture was polymerized at a temperature of 300° C. for 1 hour with stirring under a pressure of 0 kgf/cm$^2$G. After the polymerization was over, the reaction mixture was washed with water and then filtrated with a filter to remove the catalyst, thereby obtaining a crude pitch. The thus obtained crude pitch was heated at a temperature of 350° C. for 30 min under a pressure of 12 Torr while introducing nitrogen gas thereinto to remove the volatile components therefrom, thereby obtaining a carbonaceous pitch (II).

The thus obtained carbonaceous pitch (II) exhibited optical isotropy under a polarizing microscope, the physical properties thereof being shown in Table 1.

The thus obtained carbonaceous pitch (II) was introduced into a cylinder barrel provided with a nozzle of 0.3 mm in diameter and after melting the pitch by heating to a temperature of 275° C., the molten pitch was spun into fibers by extruding from the nozzle under a pressure of 0.8 kgf/cm$^2$G and the thus spun pitch fibers were taken-up at a rate of about 600 m/min. The thus obtained pitch fibers were subjected to infusibilization by heating to a temperature of 250° C. at a rate of about 1° C./min in air and then maintaining at a temperature of 250° C. for about 30 min in air.

The thus infusibilized fibers were carbonized by heating to a temperature of 900° C. at a rate of about 5° C./min in a nitrogen atmosphere and then subjected to heat treatment by heating to a temperature of 2000° C. at a rate of about 50° C./min and then maintaining at a temperature of 2000° C. in an argon atmosphere for about 10 min to obtain the carbon fibers of diameter of 7.5μ according to the present invention, the structure parameters of the thus obtained carbon fibers measured by X-ray diffractiometry and the mechanical properties thereof being shown in Table 2.

EXAMPLE 25

The carbon fibers obtained in Example 24 were further subjected to heat treatment by heating to a temperature of 2500° C. at a rate of about 50° C./min in an argon atmosphere and then maintaining at a temperature of 2500° C. for about 10 min in the same atmosphere.

The structure parameters measured by X-ray diffractiometry and mechanical properties of the thus obtained carbon fibers of diameter of 7.5μ are also shown in Table 2.

EXAMPLE 26

The carbon fibers obtained in Example 24 were further subjected to heat treatment by heating to a temperature of 2800° C. at a rate of about 50° C./min in an argon atmosphere and then maintaining at a temperature of 2800° C. for about 10 min in the same atmosphere.

The structure parameters measured by X-ray diffractiometry and mechanical properties of the thus obtained carbon fibers of diameter of 7μ are also shown in Table 2.

EXAMPLE 27

Into a three-necked glass flask provided with a stirrer, 1000 g of naphthalene (first grade reagents, made by KANTO Chemical Co., Ltd.) and 100 g of $AlCl_3$ (first grade reagents, made by KANTO Chemical Co., Ltd.) as a catalyst were introduced, and the mixture was polymerized at a temperature of 100° C. for 60 hours under stirring. Then, 100 g of $AlCl_3$ (the same reagent as above) were further added to the reaction mixture and the thus obtained mixture was further polymerized for 30 hours at a temperature of 210° C. After the polymerization was over, the reaction mixture was washed with water and then filtrated with a filter to remove the catalyst, thereby obtaining a crude hitch. The thus obtained crude pitch was heated at a temperature of 380° C. for 20 min under a pressure of 10 Torr while introducing nitrogen gas thereinto to remove the volatile components there from, thereby obtaining a carbonaceous pitch (III).

The thus obtained carbonaceous pitch (III) exhibited optical isotropy under a polarizing microscope, the physical properties thereof being shown in Table 1.

The thus obtained carbonaceous pitch (III) was introduced into a cylinder barrel provided with a nozzle of 0.3 mm in diameter and after melting the pitch by heating to a temperature of 275° C., the molten pitch was spun into fibers by extruding from the nozzle under a pressure of 1.2 kgf/cm$^2$G and the thus spun pitch fibers were taken-up at a rate of about 500 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 2000° C. at a rate of about 50° C./min and then maintaining at a temperature of 2000° C. in an argon atmosphere for about 10 min to obtain the carbon fibers of diameter of 8μ according to the present invention, the structure parameters of the thus obtained carbon fibers measured by X-ray diffractiometry and the mechanical properties thereof being shown in Table 2.

EXAMPLE 28

The carbon fibers obtained in Example 27 were further subjected to heat treatment by heating to a temperature of 2500° C. at a rate of about 50° C./min in an argon atmosphere and then maintaining at a temperature of 2500° C. for about 10 min in the same atmosphere.

The structure parameters measured by X-ray diffractiometry and mechanical properties of the thus obtained carbon fibers of diameter of 7.5μ are also shown in Table 2.

EXAMPLE 29

The carbon fibers obtained in Example 27 were further subjected to heat treatment by heating to a temperature of 2800° C. at a rate of about 50° C./min in an argon atmosphere and then maintaining at a temperature of 2800° C. for about 10 min in the same atmosphere.

The structure parameters measured by X-ray diffractiometry and mechanical properties of the thus obtained carbon fibers of diameter of 7.5μ are also shown in Table 2.

EXAMPLE 30

Into a three-necked glass flask provided with a stirrer, 1000 g of naphthalene (first grade reagents, made by KANTO Chemical Co., Ltd.) and 120 g of $AlCl_3$ (first grade reagents, made by KANTO Chemical Co., Ltd.) as a catalyst were introduced, and the mixture was polymerized at a temperature of 200° C. for 25 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (IV).

The thus obtained carbonaceous pitch (IV) exhibited optical isotropy under a polarizing microscope, the physical properties thereof being shown in Table 1.

The thus obtained carbonaceous pitch (IV) was introduced into a cylinder barrel provided with a nozzle of 0.3 mm in diameter and after melting the pitch by heating to a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 2000° C. at a rate of about 50° C./min and then maintaining at a temperature of 2000° C. in an argon atmosphere for about 10 min to obtain the carbon fibers according to the present invention, the structure parameters of the thus obtained carbon fibers measured by X-ray diffractiometry and the mechanical properties thereof being shown in Table 2.

EXAMPLE 31

The carbon fibers obtained in Example 30 were further subjected to heat treatment by heating to a temperature of 2500° C. at a rate of about 50° C./min in an argon atmosphere and then maintaining at a temperature of 2500° C. for about 10 min in the same atmosphere.

The structure parameters measured by X-ray diffractiometry and mechanical properties of the thus obtained carbon fibers are also shown in Table 2.

EXAMPLE 32

The carbon fibers obtained in Example 30 were further subjected to heat treatment by heating to a temperature of 2800° C. at a rate of about 50° C./min in an argon atmosphere and then maintaining at a temperature of 2800° C. for about 10 min in the same atmosphere.

The structure parameters measured by X-ray diffractiometry and mechanical properties of the thus obtained carbon fibers are also shown in Table 2.

EXAMPLE 33

Into a three-necked glass flask provided with a stirrer, 1000 g of naphthalene (first grade reagents, made by KANTO Chemical Co., Ltd.) and 150 g of $AlCl_3$ (first grade reagents, made by KANTO Chemical Co., Ltd.) as a catalyst were introduced, and the mixture was polymerized at a temperature of 200° C. for 25 hours under stirring. After the polymerization was over, the reaction mixture was washed with water and then filtrated with a filter to remove the catalyst, thereby obtaining a crude pitch. The thus obtained crude pitch was heated at a temperature of 400° C. for 15 min under a pressure of 15 Torr while introducing nitrogen gas thereinto to remove the volatile components therefrom, thereby obtaining a carbonaceous pitch (V).

The thus obtained carbonaceous pitch (V) exhibited optical isotropy under a polarizing microscope, the physical properties thereof being shown in Table 1.

The thus obtained carbonaceous pitch (V) was introduced into a cylinder barrel provided with a nozzle of 0.3 mm in diameter and after melting the pitch by heating t a temperature of 280° C., the molten pitch was spun into fibers by extruding from the nozzle under a pressure of 1.2 kgf/cm$^2$G and the thus spun pitch fibers were taken-up at a rate of about 700 m/min. The thus obtained pitch fibers were subjected to infusibilization by heating to a temperature of 265° C. at a rate of about 1° C./min in air and then maintaining at a temperature of 265° C. for about 30 min in air.

The thus infusibilized fibers were carbonized by heating to a temperature of 900° C. at a rate of about 5° C./min in a nitrogen atmosphere and then subjected to heat treatment by heating to a temperature of 2000° C. at a rate of about 50° C./min and then maintaining at a temperature of 2000° C. in an argon atmosphere for about 10 min to obtain the carbon fibers according to the present invention, the structure parameters of the thus obtained carbon fibers measured by X-ray diffractiometry and the mechanical properties thereof being shown in Table 2.

EXAMPLE 34

The carbon fibers obtained in Example 33 were further subjected to heat treatment by heating to a temperature of 2500° C. at a rate of about 50° C./min in an argon atmosphere and then maintaining at a temperature of 2500° C. for about 10 min in the same atmosphere.

The structure parameters measured by X-ray diffractiometry and mechanical properties of the thus obtained carbon fibers are also shown in Table 2.

EXAMPLE 35

The carbon fibers obtained in Example 33 were further subjected to heat treatment by heating to a temperature of 2800° C. at a rate of about 50° C./min in an argon atmosphere and then maintaining at a temperature of 2800° C. for about 10 min in the same atmosphere.

The structure parameters measured by X-ray diffractiometry and mechanical properties of the thus obtained carbon fibers are also shown in Table 2.

TABLE 1

| Physical Properties of Carbonaceous Pitch | Pitch | | | | |
|---|---|---|---|---|---|
| | (I) | (II) | (III) | (IV) | (V) |
| Softening point (°C.) | 195 | 187 | 191 | 195 | 196 |
| Content of benzene-insolubles (wt. %) | 42.9 | 39.7 | 42.0 | 40.7 | 41.4 |
| Content of quinoline-insolubles (wt. %) | 0 | 0 | 0 | 0 | 0 |
| Atomic ratio of hydrogen to carbon (H/C) | 0.64 | 0.67 | 0.70 | 0.65 | 0.63 |
| Average molecular weight | 1,300 | 1,000 | 1,200 | 1,100 | 1,200 |

TABLE 2

| Structure Parameters and Mechanical Properties of Carbon Fibers | | | | | | | |
|---|---|---|---|---|---|---|---|
| | | Structure Parameters | | | | | |
| Example | Heat treatment temperature (°C.) | Preferred orientation 2z (°) | Apparent crystallite size $L_{c(002)}$ (Å) | Interlayer spacing $d_{002}$ (Å) | Tensile strength (kgf/mm$^2$) | Elongation at break (%) | Young's modulus (kgf/mm$^2$) |
| 1 | 900 | 77 | 26 | 3.460 | 213 | 2.2 | 9500 |
| 2 | 1200 | 63 | 25 | 3.456 | 240 | 1.9 | 12500 |
| 3 | 900 | 59 | 26 | 3.450 | 270 | 2.7 | 10000 |
| 4 | 1200 | 58 | 28 | 3.449 | 286 | 2.2 | 13000 |
| 5 | 900 | 65 | 23 | 3.450 | 234 | 2.4 | 9900 |
| 6 | 1200 | 60 | 30 | 3.447 | 265 | 2.0 | 13000 |
| 7 | 900 | 65 | 22 | 3.457 | 210 | 2.1 | 9900 |
| 8 | 1200 | 60 | 30 | 3.454 | 250 | 1.9 | 13000 |
| 9 | 900 | 71 | 25 | 3.453 | 295 | 2.7 | 11000 |
| 10 | 1200 | 63 | 38 | 3.450 | 315 | 2.2 | 14000 |
| 11 | 1650 | 48 | 57 | 3.444 | 258 | 1.5 | 17000 |
| 12 | 1800 | 38 | 76 | 3.438 | 286 | 1.4 | 21000 |
| 13 | 1650 | 44 | 54 | 3.443 | 300 | 2.0 | 15000 |
| 14 | 1800 | 37 | 78 | 3.435 | 320 | 1.6 | 20000 |
| 15 | 1650 | 46 | 64 | 3.440 | 288 | 1.9 | 15000 |
| 16 | 1800 | 35 | 77 | 3.433 | 308 | 1.6 | 19500 |
| 17 | 1650 | 45 | 55 | 3.444 | 315 | 1.8 | 17500 |
| 18 | 1800 | 36 | 65 | 3.438 | 340 | 1.7 | 20000 |
| 19 | 1650 | 46 | 58 | 3.443 | 340 | 1.9 | 17500 |
| 20 | 1800 | 37 | 70 | 3.438 | 350 | 1.7 | 20000 |
| 21 | 2000 | 28 | 95 | 3.432 | 318 | 1.3 | 25500 |
| 22 | 2500 | 25 | 116 | 3.416 | 367 | 1.1 | 35000 |
| 23 | 2800 | 24 | 137 | 3.406 | 390 | 1.0 | 39500 |
| 24 | 2000 | 29 | 101 | 3.427 | 340 | 1.4 | 23900 |
| 25 | 2500 | 22 | 142 | 3.413 | 370 | 1.2 | 32500 |
| 26 | 2800 | 22 | 163 | 3.397 | 394 | 1.1 | 36700 |
| 27 | 2000 | 24 | 90 | 3.427 | 319 | 1.2 | 26700 |
| 28 | 2500 | 19 | 152 | 3.404 | 360 | 1.0 | 36000 |
| 29 | 2800 | 18 | 170 | 3.397 | 380 | 0.9 | 42000 |
| 30 | 2000 | 29 | 105 | 3.430 | 350 | 1.6 | 21000 |
| 31 | 2500 | 22 | 132 | 3.413 | 380 | 1.0 | 37500 |
| 32 | 2800 | 21 | 145 | 3.402 | 390 | 0.8 | 47000 |
| 33 | 2000 | 27 | 110 | 3.429 | 360 | 1.5 | 24000 |
| 34 | 2500 | 24 | 130 | 3.413 | 385 | 1.1 | 35000 |
| 35 | 2800 | 22 | 160 | 3.403 | 390 | 0.9 | 45000 |

What is claimed is:

1. In a process for producing carbon fibers comprising polymerizing naphthalene at a temperature of not more than 330° C. in the presence of a Lewis acid catalyst for 0.5 to 100 hours, after removing the catalyst from reaction mixture, heating the thus obtained polymeric material under an atmospheric pressure or a reduced pressure while introducing an inert gas thereinto to remove volatile components therefrom, thereby obtaining a pitch for melt-spinning, melt-spinning pitch fibers from the thus obtained pitch, infusibilizing the thus obtained pitch fibers, carbonizing the thus infusibilized fibers by heating to a temperature of 900° C. or less in an inert atmosphere and subjecting the thus obtained carbon fibers to heat treatment at a temperature of not less than 900° C., the improvements comprising (1) heat-treating a polymeric material of naphthalene at a temperature of 330° to 440° C. for not more than 40 minutes to produce an optically isotropic pitch having a softening point of 180° to 200° C., an atomic ratio of hydrogen to carbon (H/C) of 0.6 to 0.8 and an average molecular weight of 800 to 1500, and containing 35 to 45% by weight of benzene-insoluble without containing any quinoline-insolubles and (2)

melt-spinning pitch fibers from said optically isotropic pitch, and infusibilizing and carbonizing the pitch fibers, thereby obtaining carbon fibers having an apparent crystallite size ($L_{c(002)}$) of 15 to 200 Å and an interlayer spacing ($d_{002}$) of 3.371 to 3.47 Å measured by X-ray diffractometry.

2. The process according to claim 1, wherein the heat-treatment of said polymeric material of naphthalene is carried out at a temperature of 350° to 420° C. for 1 to 30 minutes.

3. The process according to claim 1, wherein carbonized fibers obtained form said optically isotropic pitch are subjected to heat treatment at a temperature of 900° to 1600° C., thereby producing carbon fibers having a preferred orientation (22°) of larger than 50°, an apparent crystallite size ($L_{c(002)}$) of 15 to 50 Å and an interlayer spacing ($d_{002}$) of 3.44 to 3.47 Å measured by X-ray diffractometry and also having a tensile strength of not less than 200 kgf/mm$^2$ and a Young's modulus of not less than 9500 kgf/mm$^2$.

4. The process according to claim 1, wherein carbonized fibers obtained from said optically isotropic pitch are subjected to heat treatment at a temperature of over 1600° C. and below 2000° C., thereby producing carbon fibers having a preferred orientation (22°) of 30° to 50°, an apparent crystallite size ($L_{c(002)}$) of over 50 Å and less than 80 Å and an interlayer spacing ($d_{002}$) of 3.43 to 3.45 Å, measured by X-ray diffractometry and also having a tensile strength of not less than 250 kgf/mm$^2$ and a Young's modulus of not less than 15000 kgf/mm$^2$.

5. The process according to claim 1, wherein carbonized fibers obtained from said optically isotropic pitch are subjected to heat treatment at a temperature of not less than 2000° C., thereby producing carbon fibers having a preferred orientation (22°) of below 30°, an apparent crystallite size ($L_{c(002)}$) of over 80 Å and not more than 200 Å and an interlayer spacing ($d_{002}$) of 3.371 to 3.440 Å measured by X-ray diffractometry and also having a tensile strength of not less than 300 kgf/mm$^2$ and a Young's modulus of not less than 20000 kgf/mm$^2$.

6. A process for producing an optically isotropic pitch which is melt-spinnable and a precursor for carbon fibers, comprising polymerizing naphthalene at a temperature of not more than 330° C. in the presence of a Lewis acid catalyst consisting essentially of aluminum chloride or boron trifuluoride, or 0.5 to 100 hours and after removing said catalyst from the reaction mixture, heating the thus obtained polymeric material to a temperature of 330° to 440° C. for not more than 40 minutes while introducing an inert gas thereinto under an atmospheric pressure or a reduced pressure to remove volatile components therefrom.

7. An optically isotropic pitch which is melt-spinnable and a precursor for carbon fibers, having a softening point of 180° to 200° C., an atomic ratio of hydrogen to carbon of 0.6 to 0.8 and an average molecular weight of 800 to 1500, and containing 35 to 45% by weight of benzene-insolubles without containing any quinoline-insolubles, produced by the process according to claim 6.

8. The process according to claim 1, wherein the Lewis acid catalyst consists essentially of aluminum chloride or boron trifluoride.

9. The process according to claim 1, wherein the Lewis acid catalyst consists essentially of aluminum chloride.

* * * * *

UNITED STATES PATENT AND TRADEMARK OFFICE

CERTIFICATE OF CORRECTION

PATENT NO. : 4,863,708

DATED : SEPTEMBER 5, 1989

INVENTOR(S) : Ikuo SEO et al

It is certified that error appears in the above-identified patent and that said Letters Patent is hereby corrected as shown below:

On the Title page, heading [30], "49-193245" should read -- 59-193245 --;

"49-193246" should read -- 59-193246 --;

"49-193247" should read -- 59-193247 --.

Signed and Sealed this

Seventh Day of April, 1992

*Attest:*

HARRY F. MANBECK, JR.

*Attesting Officer*

*Commissioner of Patents and Trademarks*